United States Patent [19]

Nakagawa

[11] 4,146,797

[45] Mar. 27, 1979

[54] DEVICE FOR DETECTING THE POSITION OF WEB SIDE EDGE

[75] Inventor: Hiroshi Nakagawa, Yokohama, Japan

[73] Assignee: Tokyo Kikai Seisakusho, Ltd., Tokyo, Japan

[21] Appl. No.: 857,135

[22] Filed: Dec. 5, 1977

[30] Foreign Application Priority Data

Dec. 30, 1976 [JP] Japan ..... 51-159251

[51] Int. Cl.[2] ..... B65H 25/26

[52] U.S. Cl. ..... 250/548; 242/57.1; 226/20

[58] Field of Search ..... 250/548, 561, 571; 356/199; 242/57.1; 226/20

[56] References Cited

U.S. PATENT DOCUMENTS

| | | | |
|---|---|---|---|
| 3,232,547 | 2/1966 | Thiede et al. | 242/57.1 |
| 3,368,726 | 2/1968 | Funk et al. | 226/20 |
| 3,570,735 | 3/1971 | Kurz | 242/57.1 |
| 3,833,816 | 9/1974 | Emura et al. | 356/199 |
| 3,912,193 | 10/1975 | Calvaer | 250/548 |
| 4,021,031 | 5/1977 | Meihofer | 250/561 |
| 4,049,213 | 9/1977 | Hank et al. | 242/57.1 |
| 4,077,579 | 3/1978 | Seleski et al. | 250/548 |

*Primary Examiner*—John Kominski

[57] ABSTRACT

A device for detecting the position of the side edge of a web comprising a light emitting source, and a lens for condensing light emitted from said light emitting source and forming a beam of light in the vicinity of a reference datum point set at the side edge of said web. An optical fiber transmits light corresponding to the brightness of three predetermined areas of the beam. A first area is located toward web side of the datum point; the second area is located on the opposite side of the datum point and at a position where the side edge of the web does not cross, and the third area is located at a position between the first two areas. A photoelectric converter circuit converts the light introduced by the optical fiber from each of the three areas into respective electric signals. A comparison circuit connected to the output of said photoelectric conversion circuit compares a first voltage level corresponding to the brightness at the first area with a second voltage level corresponding to the brightness of the second area, and simultaneously compares a third voltage level corresponding to the brightness of the third area with the first or said second voltage levels. The position of side edge of said web is corrected based on the result of these comparisons.

7 Claims, 3 Drawing Figures

DEVICE FOR DETECTING THE POSITION OF WEB SIDE EDGE

BACKGROUND OF THE INVENTION

1. Field of the Invention

This invention relates to a system for detecting the position of the side edge of a web, and more particularly for constantly detecting the position of the side edge of a travelling web and correcting the lateral deviation of the travelling web by controlling a web feeding means based on the result of the detection.

2. Description of the Prior Art

On a rotary press, it is normally required to keep the roll of printing paper running at a fixed position without lateral deviation with respect to the rotary press. This is done by holding the roll of printing paper to run at a correct position, for example, by adjusting the position of a feeding means such as guide rollers of the travelling web. One end being fixed and the other end being free to move horizintally based on the result of the detection of the position of the side edge of the roll of printing paper using the side edge itself as the detecting point.

Conventionally, such a system is already known which comprises 2 units of photoelectric devices. One unit is so installed as to emit light on a designated position referred as the first position and which is located slightly inward of the datum side edge of a travelling roll of paper. The datum side edge being defined as the position of the side edge of a web while it is run at a correct position. This unit detects whether the light passes through said first position or not. The other unit is installed so as to emit light to another designated position referred as second position which is located slightly away from the datum side edge in the direction contrary to the web side. The second unit detects whether the light passes through the second position or not. The position of the side edge of the web is detected based on the results of the detection by both photoelectric devices. The two units of photoelectric device are in many cases intalled side by side in a plane parallel to the surface of the travelling roll of paper and in a direction perpendicular to the direction of travel of the paper. However, with this arrangement, it is difficult to obtain accurate detection due to the fact that the setting of the units at the first position and second positions is dependent on the size of the photoelectric device itself.

SUMMARY OF THE INVENTION

It is an object of the present invention to provide a device for detecting the position of the side edge of a web which is designed so as to solve the above problems.

An object of the present invention is to provide a device for detecting the position of the side edge of a web comprising a detector unit which is designed so as to emit light onto the position of the side edge of a web and detect the brightness of the lighted position by the light reflected from said lighted position, whereby the condition for installation can be sufficiently improved.

Another object of the present invention is to provide a device for detecting the position of the side edge of a web which is designed to divide the lighted position into three areas and to be capable of comparing the brightness of each of said areas with each other, whereby the accuracy of detecting the position of the side edge of a web can be adequately improved.

DETAILED DESCRIPTION OF PREFERRED EMBODIMENTS

Figure 1:
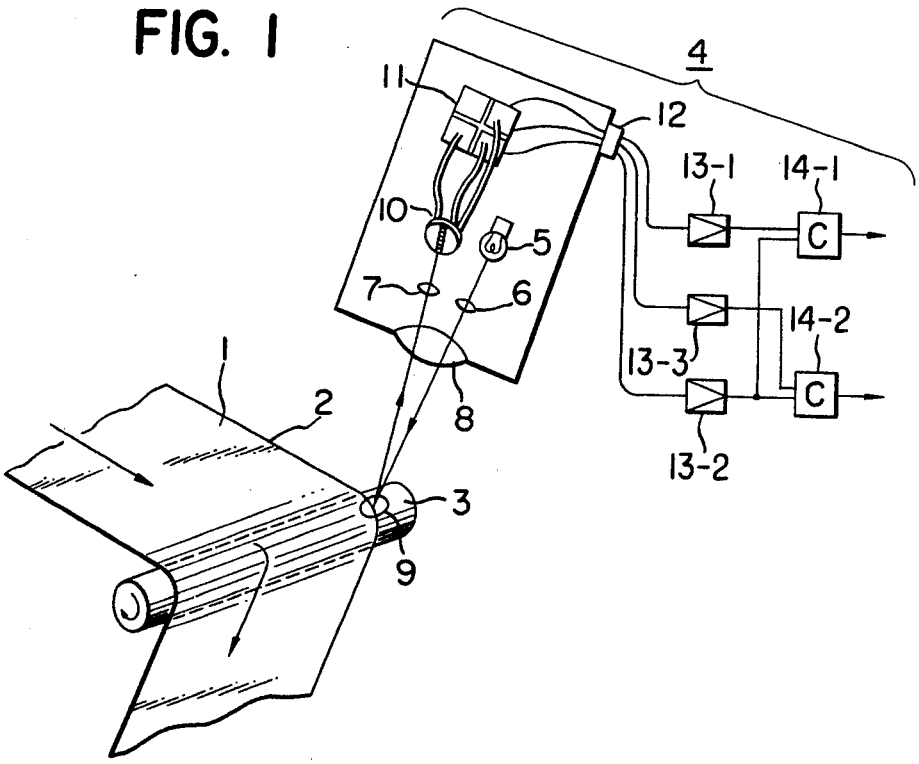
FIG. 1 illustrates an embodiment of the device for detecting the position of the side edge of a web of the present invention.

In FIG. 1, reference numeral 1 indicates a web e.g. a travelling roll of paper such as a printing paper. Numeral 2 shows the side edge of the web 1. Numeral 3 shows a feeding means e.g. a guide roller whose surface is treated so as not to easily reflect light as compared with web 1. Numeral 4 indicates a device for detecting the position of the side edge of the web. Numeral 5 shows a light emitting source. Numerals 6 and 7 show small lenses respectively. Numeral 8 shows a large lens Numeral 9 shows a beam of light. Numeral 10 shows an optical fiber. Numeral 11 shows a photoelectric conversion circuit. Numeral 12 shows a connector for an outgoing line Numerals 13–1, 13–2 and 13–3 indicate amplifier circuits respectively, and numerals 14–1 and 14–2 show comparison circuits respectively.

Figure 2:
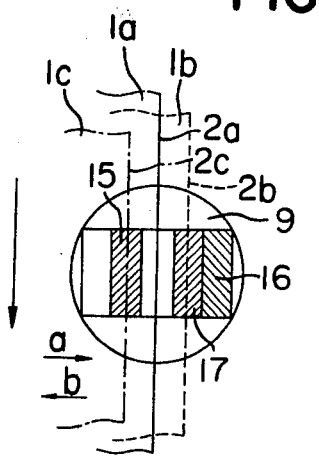
FIG. 2 is a schematic illustration of the relationship between the position of the beam of light and that of the side edge of travelling paper shown in FIG. 1

The light emitted from the light emitting source 5 is made to pass through the small lens 6 and the large lens 8 to form a light beam 9 in the vicinity of the side edge 2 of the web 1. The reflected light from the light beam 9 enters the optical fiber 10 after passing through the large lens 8 and the small lens 7. At this point, the optical fiber 10 introduces light corresponding to the brightness of each of three areas of the light beam 9. Namely, first area 15, second area 16 and third area 17 as shown in FIG. 2. Code **1*a* shown in FIG. 2 indicates the condition of the travelling paper 1 when it is fed in a correct condition without being laterally deviated. Numeral 2*a* shows the side edge of a travelling paper 1*a* and this location defines the datum position. Numerals 1*b* and 1*c* respectively show the travelling paper when it is deviated laterally to the right or left, and numerals 2*b* and 2*c*** show respectively the side edges of the travelling paper at their respective conditions.

Figure 3:
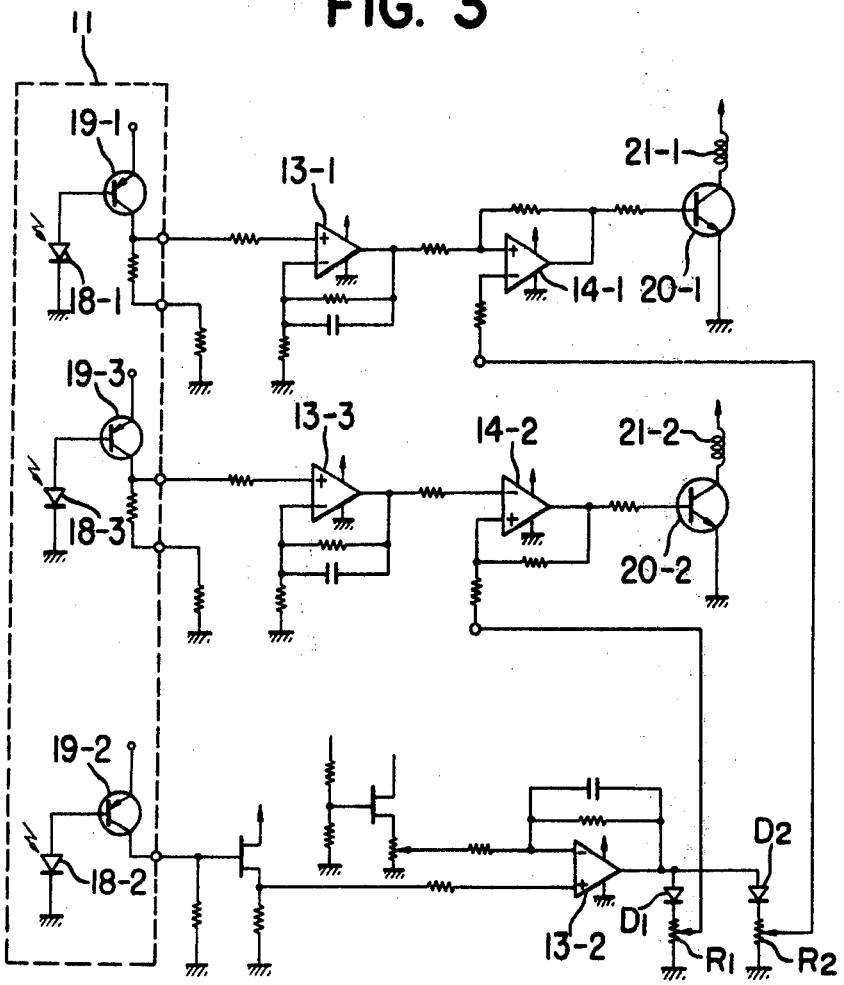
FIG. 3 shows an embodiment of the electric circuit components in the embodiment of the device for detecting the position of side edge of a web as is illustrated in FIG. 1.

The light corresponding to the brightness of first area 15, that corresponding to the brightness of second area 16 and that corresponding to the brightness of third area 17, which introduced by the optical fiber 10 are respectively converted into electric signals by the photoelectric conversion circuit 11. The converted electric signals are then respectively inputted into the amplifier circuits 13–1, 13–2 and 13–3 through the connector for the outgoing line 12. The comparison circuit 14–1 compares the output of the amplifier circuit 13–1 amplifying the electric signal corresponding to said first area 15, with the output of the amplifier circuit 13–2 amplifying the electric signal corresponding to said second area 16. The comparison circuit 14–2 compares the output of the amplifier circuit 13–2 with that of the amplifier circuit 13–3 amplifying the electric signal corresponding to said third area 17. The travelling paper 1 is returned to its correct position by driving and controlling a feeding means, e.g. one end of a guide roller 3 in the direction to the left or right based on the output of the comparison circuit 14–1 and comparison circuit 14–2. FIG. 3 in which the electric circuit illustrating the photoelectric conversion circuit 11 and circuits following it, will now be described.

In FIG. 3 reference numeral 11 shows a photoelectric conversion circuit. Numerals 13–1, 13–2 and 13–3 show amplifier circuits respectively. Numerals 14–1, and 14–2 show comparison circuits, e.g. differential amplifiers. Numerals 18–1, 18–2 and 18–3 show light receiving diodes respectively. Numerals 19–1, 19–2 and 19–3 show transistors respectively, wherein each flows a collector current proportionally corresponding to the amount of light received by each of said light receiving diodes 18–1, 18–2 and 18–3, respectively. Numerals 20–1 and 20–2 show transistors which drive and control relay windings 21–1 and 21–2, to be described later, and form together with the relay windings 21–1 and 21–2 a roller drive and control circuit of the present invention. Numeral 21–1 shows a relay winding which when energized, drives a feeding means 3 so as to have the travelling paper (1*a*, 1*b*, 1*c*) shown in FIG. 2, move to the right in the direction of arrow a shown in FIG. 2. Numeral 21–2 shows a relay winding which, when energized, drives the feeding means 3 so as to have the travelling paper (1*a*, 1*b*, 1*c*) shown in FIG. 2 move to the left in the direction of arrow b shown in FIG. 2.

In the photoelectric conversion circuit 11, the light receiving diodes 18–1, 18–2 and 18–3, as well as the transistors 19–1, 19–2 and 19–3 are all formed on the same printed circuit board. The light receiving diode 18–1 and transistor 19–1 located in the upper portion convert the brightness of the first area 15 into an electric signal. The light receiving diode 18–2 and transistor 19–2 located in the lower portion convert the brightness of the second area 16 into an electric signal, and the light receiving diode 18–3 and transistor 19–3 located in the intermediate portion convert the brightness of the third area 17 into an electric signal.

The collector voltage of the upper transistor 19–1 is amplified by the amplifier circuit 13–1 and inputted into the positive input terminal of the comparison circuit 14–1. The collector voltage of the intermediate transistor 19–3 is amplified by the amplifier circuit 13–3 and inputted into the negative input terminal of the comparison circuit 14–2. The collector voltage of the lower transistor 19–2 is amplified by the amplifier circuit 13–2 and outputted to a series circuit composed of diode $D_1$ and resistor $R_1$, and a series circuit composed of diode $D_2$ and resistor $R_2$. The split voltage of the resistor $R_1$ is inputted into the positive input terminal of the comparison circuit 14–2, while the split voltage of the resistor $R_2$ is inputted into the negative input terminal of the other comparison circuit 14–1. Comparison circuit 14–1 controls the base current of transistor 20–1 by comparing an input voltage level from the amplifier circuit 13–3 with an input voltage level from resistor $R_1$. Comparison circuit 14–2 controls the base current of transistor 20–2 by comparing an input voltage level from the amplifier circuit 13–3 with an input voltage level from the resistor $R_1$. Comparison circuit 14–1 is arranged so as to make the input voltage level being inputted into its positive input terminal equal to the input voltage level being inputted into its negative input terminal when the travelling paper is located at its correct position, that is, the condition of the travelling paper shown by solid lines (1*a*, 2*a*) in FIG. 2. The same arrangement is made with comparison circuit 14–2. Description of the cases in which (1) the traveling paper 1 is running at its correct position as shown by solid lines (1*a*, 2*a*) in FIG. 2, (2) travelling paper 1 is running at a position as shown by broken lines (1*b*, 2*b*) in FIG. 2 and (3) the travelling paper 1 is running at a position deviated tothe left from its correct position as shown by point and chain lines (1*c*, 2*c*) in FIG. 2, will now be given below.

In the case of (1), as aforementioned the difference between each input voltage level in the comparison circuit 14–1 and comparison circuit 14–2 is zero. Consequently, both transistors 20–1 and 20–2 are not supplied with the base current, and both transistor 20–1 and 20–2 are maintained in off condition. Due to this, no current is supplied to the relay windings 21–1 and 21–2, and the feeding means 3 (FIG. 1) is not driven. In other words the travelling paper is kept running at its correct position.

In the case of (2), the brightness of third area 17 (FIG. 2) becomes larger compared with the brightness of this area in the case of the above example (1). Because of this, the collector current of transistor 19–3 corresponding to said third area 17 is increased and subsequently the collector output voltage is increased. On the other hand, the brightness at first area 15 and the brightness at second area are maintained at the same level as that of the above example (1). Due to this, only the negative input terminal voltage of the comparison circuit 14–2 is increased compared with the case of the above example (1). The transistor 20–2 is therefore turned on as the output voltage of the comparison circuit 14–2 is increased, and the feeding means 3 is driven as a current flows through the relay winding 21–2. At this time, the transistor 20–1 is still in an off condition, and a current does not flow in the relay winding 21–1. Consequently, the travelling paper 1 is moved to the left, that is, in the direction of an arrow b from its condition shown by broken lines (1*b*, 2*b*) in FIG. 2. In other words, the travelling paper 1 is made to return to its correct position.

In the case of example (3), the brightness at first area 15 (FIG. 2) becomes smaller compared with the case of example (1) above.Because of this, the collector current of the transistor 19–1 corresponding to first area 15 is decreased, and subsequently the collector voltage is decreased. On the other hand, the brightness at second area 16 and third area 17 is maintained at the same level as that of the case of example (1) above. Due to this, only the positive input terminal voltage of the comparison circuit 14–1 is decreased compared with the case of example (1) above. The transistor 20–1 is therefore turned on as the output voltage of the comparison circuit 14–1 is increased, and a current flows through the relay winding 21–1. Consequently, the travelling paper 1 is moved to the right, that is, in the direction of an arrow a from its condition shown by lines (1*c*, 2*c*) in FIG. 2. In other words, the travelling paper 1 is made to return to its correct position.

As aforementioned, in the case of the present invention, it is possible to accommodate the light emitting source 5, lenses 6, 7 and 8, optical fiber 10 and photoelectric conversion circuit 11 in one case, whereby the installation condition, which has so far been regarded as a problem, can be sufficiently improved. Also, by the provision of an optical fiber 10, it has become possible to detect the brightness of each of areas 15, 16 and 17 which are very closely located to each other at the side edge of a web, whereby the accuracy of detecting the side edge of a web can be improved.

In the case of the present invention, a description has been given about the case in which third area 17 in the aforementioned embodiment is located to the right of the datum side edge *2a* as illustrated in FIG. 2. It is needless to say that a similar effect can be obtained by making such an arrangement in which third area 17 is placed at a designated position located to the left of the datum side edge *2a* and between first area 15 and second area 16.

What is claimed is:

1. A system for detecting the side edge position of a web, comprising, a light emitting source, a lens system for collecting light emitted from said light emitting source and forming a light beam in the vicinity of a datum position provided at the side edge of said web, an optical fiber for introducing light corresponding to the receiving light reflected by said light beam and for transmitting light corresponding to the brightness of predetermined areas of said light beam, a first area being located on the web side of said datum position, and a second area being located on the opposite side of said datum position and at a position where the side edge of the web does not cross, and a third area located between said first and second areas, a photoelectric conversion circuit for converting the transmitted light from each of said areas into respective electric signals, and comparison circuits connected to the output side of said photoelectric conversion circuit for comparing a first voltage level corresponding to the brightness of said first area with a second voltage level corresponding to the brightness of said second area, and simultaneously for comparing a third voltage level corresponding to the brightness of said third area with one of said first and second voltage levels.

2. The system for detecting the side edge position of a web as set forth in claim 1 further comprising a housing accommodating said light emitting source, said lens, said optical fiber and said photoelectric conversion circuit.

3. The system for detecting the side edge position of a web as set forth in claim 2 wherein said photoelectric conversion circuit comprises for each of said areas a light receiving diode and a corresponding transistor whose base is connected to its respective light receiving diode.

4. The system for detecting the side edge position of a web as set forth in claim 3 wherein said comparison circuit comprises a differential amplifier.

5. The system for detecting the side edge position of a web as set forth in claim 4 and further comprising a roller drive and control circuit for respectively driving and controlling a guide roller which is connected to the output side of said comparison circuit.

6. The system for detecting the side edge position of a web as set forth in claim 1 wherein said web is printing paper.

7. The system for detecting the side edge position of a web as set forth in claim 6 and further comprising a guide roller through which said web runs, the light reflectivity of said guide roller being different from that of said web and wherein at least a part of said light beam is formed on the surface of said guide roller.

* * * * *